US011199789B2

(12) United States Patent
Kusano et al.

(10) Patent No.: US 11,199,789 B2
(45) Date of Patent: Dec. 14, 2021

(54) IMAGE FORMING UNIT AND IMAGE FORMING APPARATUS

(71) Applicant: CANON KABUSHIKI KAISHA, Tokyo (JP)

(72) Inventors: Yohei Kusano, Tokyo (JP); Hiroki Shimizu, Suntou-gun (JP); Toshiaki Takeuchi, Susono (JP); Hideki Kakuta, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/022,411

(22) Filed: Sep. 16, 2020

(65) Prior Publication Data

US 2021/0080862 A1 Mar. 18, 2021

(30) Foreign Application Priority Data

Sep. 17, 2019 (JP) ..... JP2019-168875

(51) Int. Cl.
*G03G 15/08* (2006.01)
*G03G 21/18* (2006.01)

(52) U.S. Cl.
CPC ..... *G03G 15/0862* (2013.01); *G03G 21/1814* (2013.01)

(58) Field of Classification Search
CPC ..... G03G 15/0856; G03G 15/0858; G03G 15/0862; G03G 2215/0888
See application file for complete search history.

(56) References Cited

U.S. PATENT DOCUMENTS

| | | | |
|---|---|---|---|
| 5,068,691 | A | 11/1991 | Nishio |
| 5,893,007 | A | 4/1999 | Lim |
| 6,246,841 | B1 | 6/2001 | Merrifield |
| 6,445,888 | B1 | 9/2002 | Fujiwara |

(Continued)

FOREIGN PATENT DOCUMENTS

| | | | |
|---|---|---|---|
| JP | H09114225 | A | 5/1997 |
| JP | 2008145793 | A | 6/2008 |

OTHER PUBLICATIONS

Notice of Allowance issued in U.S. Appl. No. 17/022,346 dated Aug. 19, 2021.

(Continued)

*Primary Examiner* — Thomas S Giampaolo, II
(74) *Attorney, Agent, or Firm* — Rossi, Kimms & McDowell LLP

(57) ABSTRACT

Provided is an image forming unit including a photosensitive unit including an image bearing member, a developing unit including a developer bearing member and a container capable of containing a developer, a rotation shaft, the developing unit being rotated around the rotation shaft and positioned at one of a development position where the developer bearing member supplies the developer to the image bearing member and a separation position where the developer bearing member separates from the image bearing member, and a sensing portion sensing a variation or an amount corresponding to an amount of the developer contained in the developing unit. The rotation shaft is located below a developing portion, which is formed of the image bearing member and the developer bearing member, in a gravity direction.

9 Claims, 14 Drawing Sheets

(56) References Cited

U.S. PATENT DOCUMENTS

| | | | | |
|---|---|---|---|---|
| 2008/0292331 | A1 | 11/2008 | Yokomori | |
| 2013/0272727 | A1 | 10/2013 | Hirukawa | |
| 2013/0279921 | A1 | 10/2013 | Kanai | |
| 2014/0093257 | A1 | 4/2014 | Seto | |
| 2017/0248909 | A1* | 8/2017 | Nakamura | G03G 21/1821 |
| 2021/0080861 | A1* | 3/2021 | Shimizu | G03G 15/0808 |

OTHER PUBLICATIONS

Extended European Search Report issued in European Appln. No. 20196374.1 dated Feb. 5, 2021.
Extended European Search Report issued in European Appln. No. 20196130.7 dated Feb. 15, 2021.

* cited by examiner

IMAGE FORMING UNIT AND IMAGE FORMING APPARATUS

BACKGROUND OF THE INVENTION

Field of the Invention

The present invention relates to an image forming unit and to an image forming apparatus.

Description of the Related Art

In an image forming apparatus using an electrophotographic image forming method (electrophotographic process), such as a printer, when an image is formed on a recording material, first, each of photosensitive drums is uniformly charged by a charging roller. Then, through selective exposure of the charged photosensitive drum by an exposing device, an electrostatic latent image is formed on the photosensitive drum. The electrostatic latent image formed on the photosensitive drum is developed as a toner image by a developing device using a toner. Then, the toner image formed on the photosensitive drum is transferred onto the recording material, such as a recording sheet or a plastic sheet. The toner image transferred onto the recording material is heated/pressed by a fixing unit to be fixed onto the recording material. Thus, the image is formed on the recording material. After the toner image is transferred onto the recording material, the toner remaining on the photosensitive drum is removed by a cleaning blade.

To perform easy maintenance of process means, such as a photosensitive drum, a charging roller, and a developing device, in such an image forming apparatus, a process cartridge is used. The process cartridge is a member obtained by integrating the process means, such as the photosensitive drum, the charging roller, a cleaning blade, and the developing device, with each other into a cartridge. The process cartridge is detachable from an apparatus main body of the image forming apparatus. Accordingly, by replacing the process cartridge, it is possible to perform easy maintenance of the process means.

There is known a configuration of such an image forming apparatus, from which a process cartridge is detachable, and having a remaining-toner-amount sensing mechanism capable of sequentially detecting an amount of a remaining toner (Patent Literature 1: Japanese Patent Application Publication No. H 09-114225).

In this image forming apparatus, a developer bearing member of a developing unit is constantly biased by a spring toward a photosensitive drum of a drum unit. Thus, from the developer bearing member to the photosensitive drum, a biasing force, a weight of the developing unit, and a pressing force determined by a weight of the toner are applied. The remaining-toner-amount sensing mechanism in Patent Literature 1 measures the pressing force to sense an amount of the remaining toner.

SUMMARY OF THE INVENTION

The remaining-toner-amount sensing mechanism in Patent Literature 1 sequentially measures a pressing force from a developing device during an operation of the developing device, and calculates the remaining toner amount on the basis of the pressing force. Then, the remaining-toner-amount sensing mechanism displays the calculated remaining toner amount to allow a user to recognize the remaining toner amount.

However, since the remaining-toner-amount sensing mechanism in Patent Literature 1 measures the pressing force including the weight of the toner, fluctuations in the pressing force may affect the measurement of the remaining toner amount. In addition, since the remaining-toner-amount sensing mechanism is configured such that, in the process cartridge, the developer bearing member is constantly biased by the pressing force including the weight of the toner toward the photosensitive drum, when creep deformation or the like occurs in a frame body, the measurement of the remaining toner amount may be affected under the influence of the creep deformation.

The present invention is achieved in view of the foregoing problem to be solved, and an object of the present invention is to provide a technique of accurately measuring a remaining toner amount in a process cartridge or a value related to the remaining toner amount.

The present invention provides an image forming unit for use in an image forming apparatus, the image forming unit comprising:

a photosensitive unit including an image bearing member;

a developing unit including a developer bearing member and a container capable of containing a developer;

a rotation shaft, the developing unit being rotated around the rotation shaft and positioned at one of a development position where the developer bearing member supplies the developer to the image bearing member and a separation position where the developer bearing member separates from the image bearing member; and a sensing portion sensing a variation or an amount corresponding to an amount of the developer contained in the developing unit, wherein the rotation shaft being located below a developing portion, which is formed of the image bearing member and the developer bearing member, in a gravity direction, and wherein the sensing portion restricting the rotation of the developing unit, thereby receiving a force from the developing unit, when the developing unit is at the separation position.

Further features of the present invention will become apparent from the following description of exemplary embodiments with reference to the attached drawings.

DESCRIPTION OF THE EMBODIMENTS

Figure 1A:
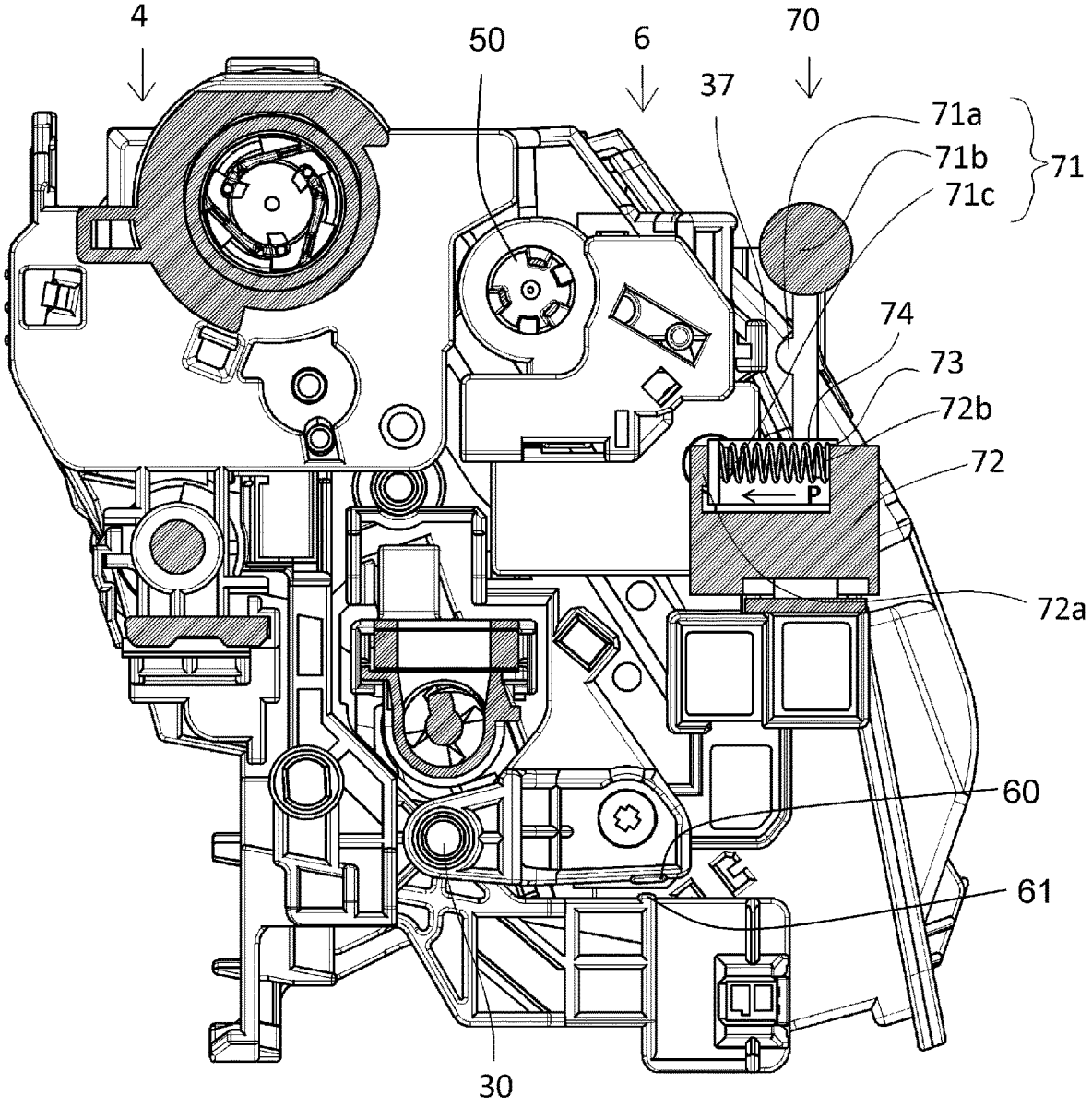
FIG. 1A is a cross-sectional view of a remaining-toner-amount sensing unit during image formation according to a first embodiment.

Referring to the drawings, preferred embodiments of the present invention will be illustratively described below in detail. However, dimensions, materials, shapes, relative positioning, and the like of components described in the embodiments are not intended to limit the scope of the invention thereto unless particularly specified otherwise.

First Embodiment

Figure 2:
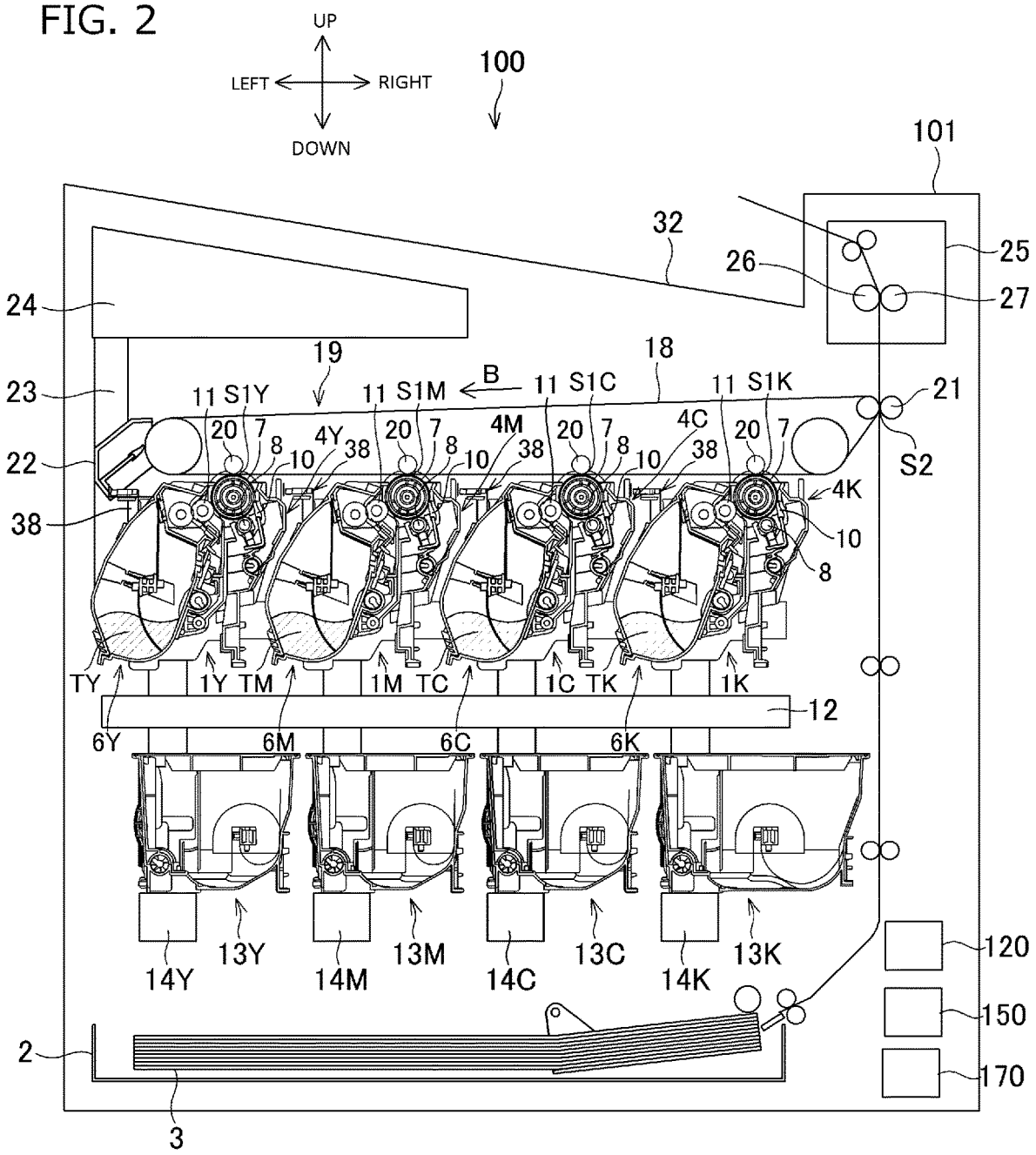
FIG. 2 is a cross-sectional view illustrating a schematic configuration of an image forming apparatus according to the first embodiment.

A description will be given of an overall configuration of an image forming apparatus 100 according to the first embodiment with reference to FIG. 2. FIG. 2 is a cross-sectional view schematically illustrating the image forming apparatus 100 according to the first embodiment. In the first embodiment, each of process cartridges 1 (image forming units) and each of toner cartridges 13 are detachable from an apparatus main body 101 of the image forming apparatus 100.

In the first embodiment, configurations and operations of first to fourth image forming portions are substantially the same except that images to be formed are in different colors. Accordingly, the configurations and operations of the first to fourth image forming portions will be generally described below by omitting indexes Y to K when there is no need to particularly distinguish the image forming portions from each other.

The first to fourth process cartridges 1 are disposed to be arranged in a horizontal direction. Each of the process cartridges 1 is formed of a photosensitive unit 4 and a developing unit 6.

The photosensitive unit 4 includes a photosensitive drum 7 serving as an image bearing member, a charging roller 8 serving as a charging means that uniformly charges a surface of the photosensitive drum 7, and a cleaning blade 10 serving as a cleaning means.

The developing unit 6 is a developing means including a developing roller 11 serving as a developer bearing member and a container capable of containing a developer T (hereinafter referred to as the toner). The developing unit 6 supplies the toner to develop an electrostatic latent image formed on the photosensitive drum 7. The photosensitive unit 4 and the developing unit 6 are supported to be swingable (rotatable) relative to each other.

Note that the first process cartridge 1Y contains a yellow (Y) toner in the developing unit 6. Likewise, the second process cartridge 1M contains a magenta (M) toner, the third process cartridge 1C contains a cyan (C) toner, and the fourth process cartridge 1K contains a black (K) toner.

Each of the process cartridges 1 is detachable from the image forming apparatus 100 via attachment means provided in the image forming apparatus 100, such as an attachment guide (not shown) and a positioning member (not shown). Below each of the process cartridges 1, a scanner unit 12 for forming the electrostatic latent image is disposed. Additionally, in the image forming apparatus, behind each of the process cartridges 1 (downstream of the process cartridge 1 in a direction in which the process cartridge 1 is attached/detached), a waste toner transport unit 23 is disposed.

The first to fourth toner cartridges 13 are disposed to be arranged in the horizontal direction below the process cartridges 1 in an order in which the first to fourth toner cartridges 13 correspond to the colors of the toners contained in the individual process cartridges 1. Specifically, the first toner cartridge 13Y contains the yellow (Y) toner. Likewise, the second toner cartridge 13M contains the magenta (M) toner, the third toner cartridge 13C contains the cyan (C) toner, and the fourth toner cartridge 13K contains the black (K) toner. Each of the toner cartridges 13 supplies the toner to the process cartridge 1 containing the toner in the same color.

Each of the toner cartridges 13 performs an operation of refeeding the toner when a remaining-toner-amount sensing unit 70 (described later) provided in the apparatus main body 101 of the image forming apparatus 100 senses an insufficient amount of the toner remaining in the process cartridge 1 or so as to hold the remaining toner amount constant. The toner cartridge 13 is detachable from the image forming apparatus 100 via the attachment means provided in the image forming apparatus 100, such as the attachment guide (not shown) and the positioning member (not shown). Note that details of the process cartridges 1 and the toner cartridges 13 will be described later.

Below the toner cartridges 13, first to fourth toner transport devices 14 are disposed to correspond to the individual toner cartridges 13. Each of the toner transport devices 14 upwardly transports the toner received from the corresponding toner cartridge 13 to supply the toner to the corresponding developing unit 6.

Above the process cartridges 1, an intermediate transfer unit 19 is provided to serve as an intermediate transfer member. Between the intermediate transfer unit 19 and the first to fourth process cartridges 1Y to 1K, first to fourth primary transfer portions (image forming portion) S1Y to S1K are formed. The intermediate transfer unit 19 is substantially horizontally disposed with a primary transfer portion S1 side thereof facing downward.

An intermediate transfer belt 18 facing each of the photosensitive drums 7 is an endless belt capable of rotation and wound in tension around a plurality of winding rollers. On an inner surface of the intermediate transfer belt 18, primary transfer rollers 20 are disposed to serve as primary transfer members. The individual primary transfer rollers 20 form the primary transfer portions S1Y to S1K via the intermediate transfer belt 18 between the primary transfer rollers 20 and the individual photosensitive drums 7.

A secondary transfer roller 21 serving as a secondary transfer member is in contact with the intermediate transfer belt 18 to form, together with a roller facing thereto, a secondary transfer portion S2 via the intermediate transfer belt 18. In addition, in a left-right direction (direction in which the secondary transfer portion S2 and the intermediate transfer belt 18 extend in tension), an intermediate-transfer-belt cleaning unit 22 is disposed opposite to the secondary transfer portion S2.

Above the intermediate transfer unit 19, a fixing unit 25 is disposed. The fixing unit is configured to include a heating unit 26 and a pressing roller 27 to be pressed into contact with the heating unit. On an upper surface of the apparatus main body 101, an ejection tray 32 is disposed. Between the ejection tray 32 and the intermediate transfer unit, a waste toner collecting container 24 is disposed. In a lowermost portion of the apparatus main body 101, a paper feed tray 2 for containing the recording material 3 is disposed.

The image forming apparatus 100 includes a control portion 120. The control portion 120 is connected to each of the components via a control line not shown to control an operation timing related to an image forming operation and perform an operation for forming an image on the basis of image data or the like in response to an instruction from a user or an instruction from a program developed in a memory. The control portion 120 may also perform various arithmetic processing according to the present invention (e.g., calculation of a pressing force or a remaining toner amount). As the control portion 120, a processing device having arithmetic resources such as a processor and the memory can be used.

The image forming apparatus 100 includes a power source portion 150. The power source portion 150 is a high-voltage power source device and supplies electric power required to drive the apparatus. The image forming apparatus 100 includes a drive portion 170. The drive portion 170 is a drive mechanism including a motor for converting the electric power to a drive force or the like, and serves as a power source for rotation of the various rollers or the like.

Image Forming Process

Next, referring to FIGS. 2 and 3, a description will be given of the image forming operation in the image forming apparatus 100.

Figure 3:
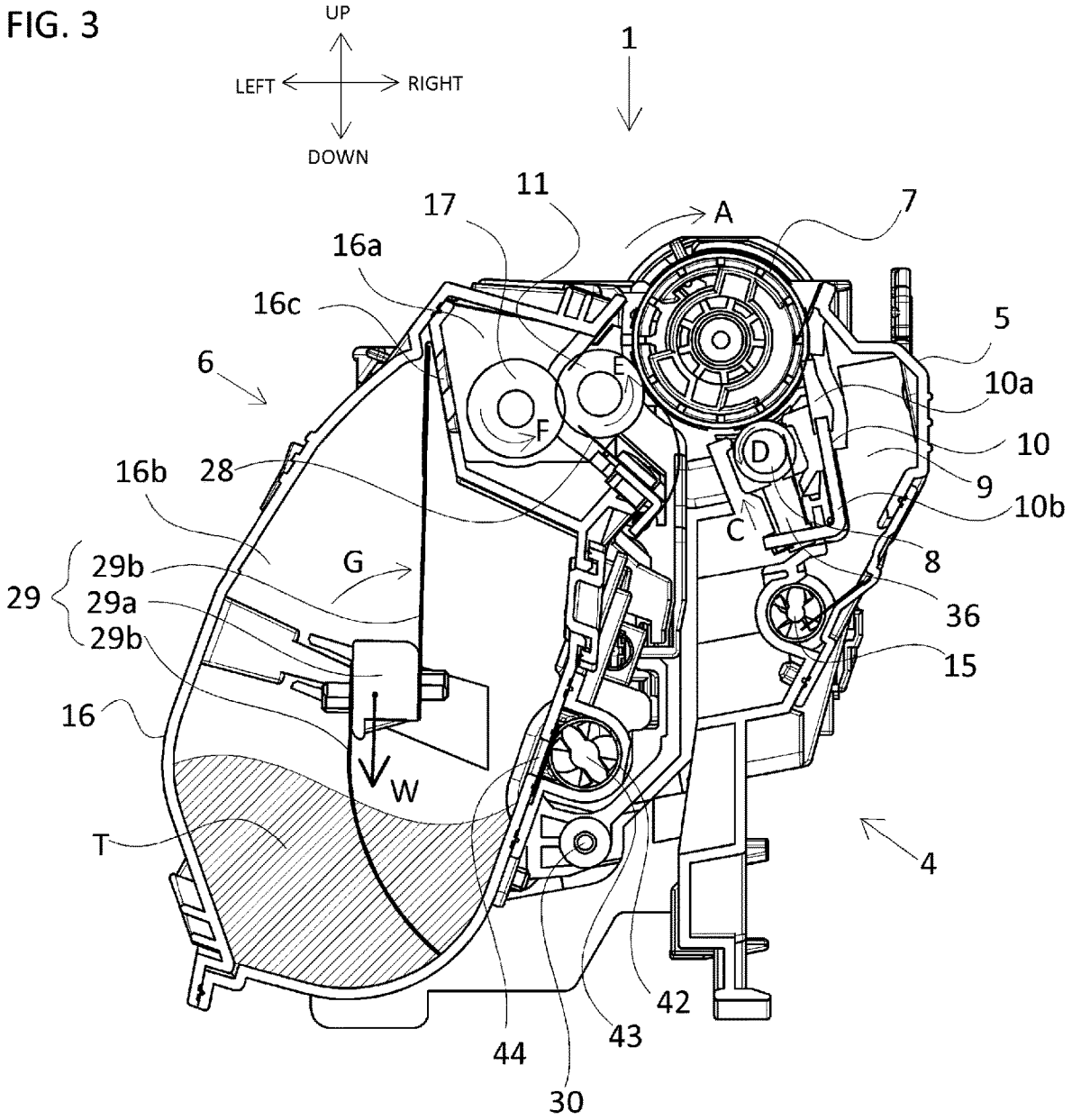
FIG. 3 is a cross-sectional view of a process cartridge according to the first embodiment.

FIG. 3 is a cross-sectional view of each of the process cartridges 1 according to the first embodiment.

During image formation, each of the photosensitive drums 7 is driven to rotate at a predetermined speed in a direction indicated by an arrow A in FIG. 3. The intermediate transfer belt 18 is driven to rotate in a direction (the forward direction with respect to the rotation direction of the photosensitive drum 7) indicated by an arrow B in FIG. 2.

First, the surface of each of the photosensitive drums 7 is uniformly charged by the charging roller 8. Then, laser light emitted from the scanner unit 12 scans/exposes the surface of the photosensitive drum 7 to form an electrostatic latent image based on image information on the photosensitive drum 7. The electrostatic latent image formed on the photosensitive drum 7 is developed as a toner image by the developing unit 6. At this time, the developing unit 6 is pressed by the corresponding one of developing/pressing units 38 provided in the main body of the image forming apparatus 100. Then, the toner image formed on the photosensitive drum 7 is primarily transferred by the primary transfer roller 20 onto the intermediate transfer belt 18. The developing/pressing unit 38 moves rightward in the drawing to press the developing unit 6, and the resulting pressing force brings the developing roller 11 into contact with the photosensitive drum 7.

For example, during formation of a full-color image, the process described above is sequentially performed in the first to fourth primary transfer portions (image forming portions) S1Y to S1K. As a result, the toner images in the individual colors are sequentially stacked on the intermediate transfer belt 18.

Meanwhile, the recording material 3 contained in the paper feed tray 2 is fed with predetermined control timing to be transported to the secondary transfer portion S2 in synchronization with movement of the intermediate transfer belt 18. Then, the toner images in the four colors on the intermediate transfer belt 18 are simultaneously secondarily transferred onto the recording material 3 by the secondary transfer roller 21 in contact with the intermediate transfer belt 18 via the recording material 3.

Then, the recording material 3 having the toner images transferred thereon is transported to the fixing unit 25. Through heating/pressing of the recording material 3 in the fixing unit 25, the tonner images are fixed to the recording material 3. Then, the recording material 3 having the toner images fixed thereto is transported to the ejection tray 32, which completes the image forming operation.

The post-primary-transfer remaining toners (waste toners) remaining on the photosensitive drums 7 after a primary transfer step are removed by the cleaning blades 10. The post-secondary-transfer remaining toners (waste toners) remaining on the intermediate transfer belt 18 after a secondary transfer step are removed by the intermediate-transfer-belt cleaning unit 22. The waste toners removed by the cleaning blades 10 and the intermediate-transfer-belt cleaning unit 22 are transported by the waste toner transport unit 23 provided in the apparatus main body 101 and stored in the waste toner collecting container 24. Note that the image forming apparatus 100 is configured to be able to also form a single-color or multi-color image using only desired one or some (not all) of the image forming portions.

Process Cartridges

Figure 4A:
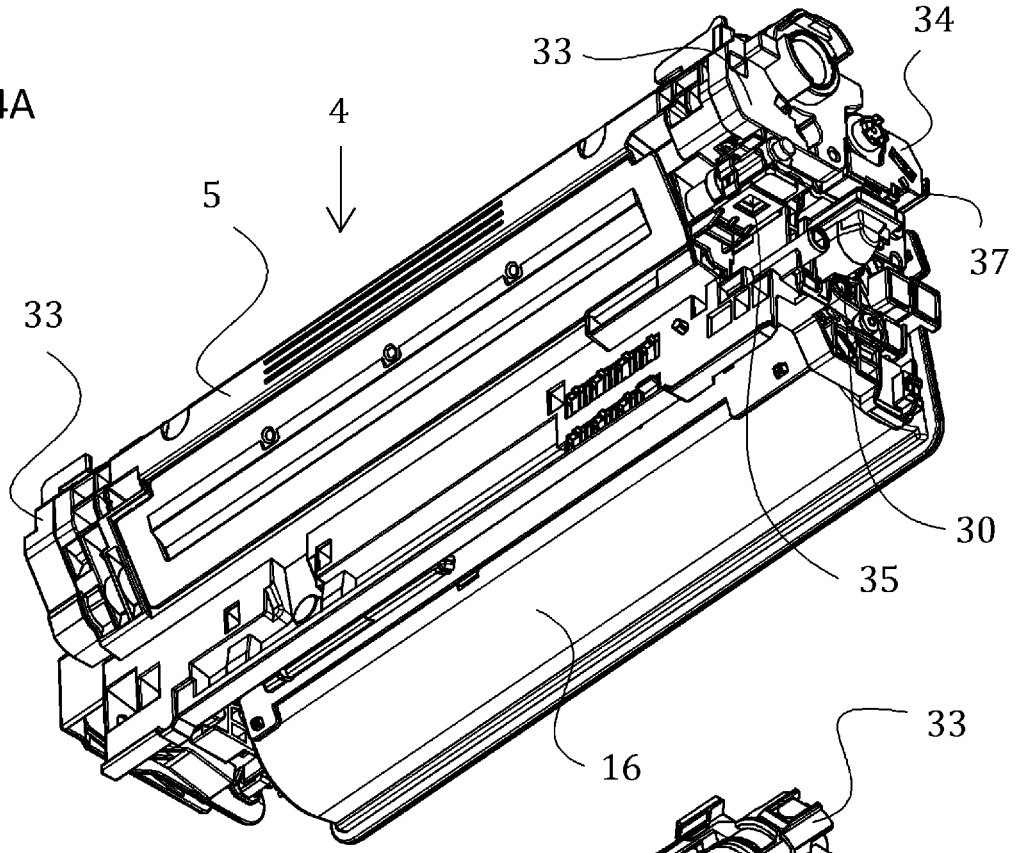
FIGS. 4A and 4B are perspective views in which the process cartridge according to the first embodiment is viewed from a bottom surface side and a top surface side.
Figure 4B:
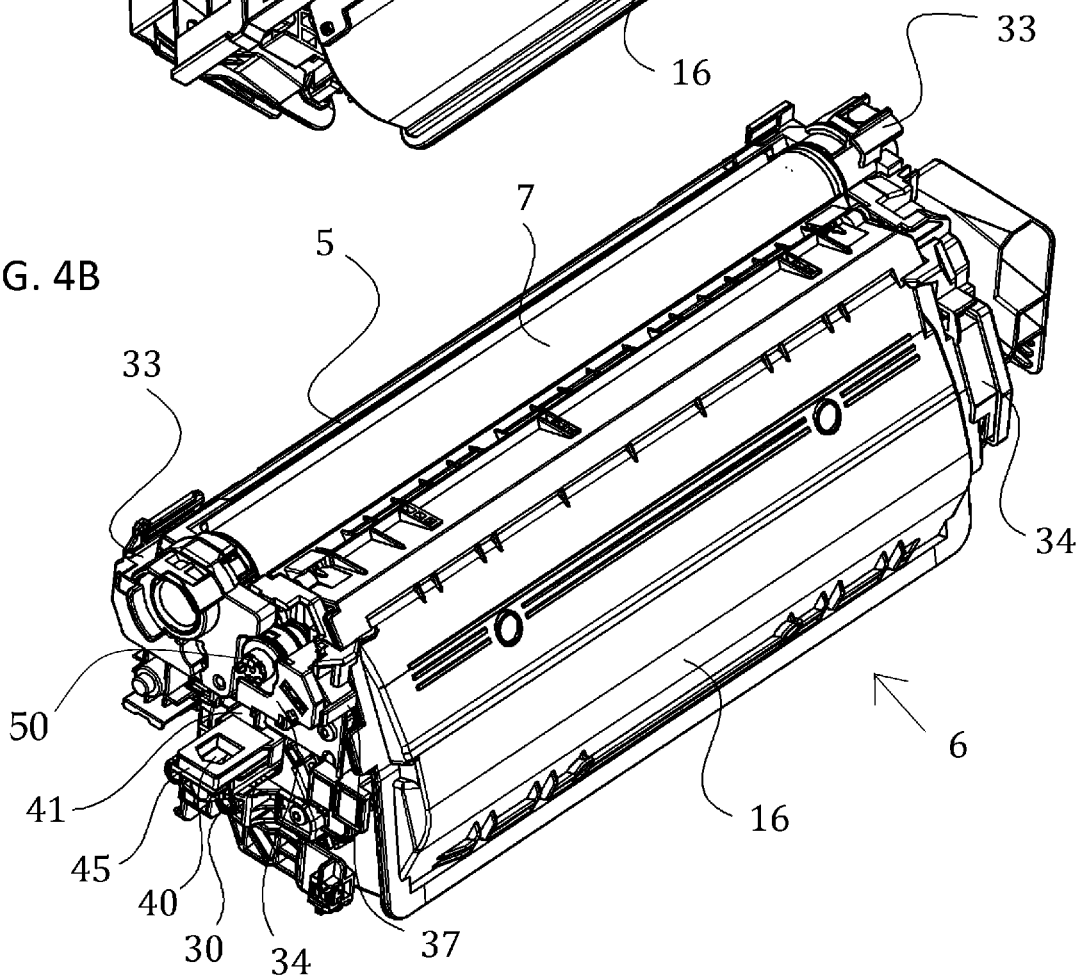

Next, referring to FIGS. 3, 4A, and 4B, a description will be given of an overall configuration of each of the process cartridges 1 to be attached to the image forming apparatus 100 according to the first embodiment. FIG. 4A is a perspective view of the process cartridge 1 when viewed from a bottom surface side. FIG. 4B is a perspective view of the process cartridge 1 when viewed from a top surface side.

Each of the process cartridges 1 is formed of the photosensitive unit 4 and the developing unit 6. The photosensitive unit 4 and the developing unit 6 are connected to be swingable (rotatable) around a rotary support pin 30 (rotation shaft).

The photosensitive unit 4 includes a photosensitive unit frame body 5 supporting various members in the photosensitive unit 4. The photosensitive unit 4 is internally provided with not only the photosensitive drum 7, the charging roller 8, and the cleaning blade 10, but also a waste toner transport screw 15 extending in a direction parallel with a direction of a rotation axis of the photosensitive drum 7. In the photosensitive unit frame body 5, cleaning bearings 33 including a row of cleaning gears for rotatably supporting the photosensitive drum 7 and transmitting driving from the photosensitive drum to the waste toner transport screw 15 are disposed at both longitudinal ends of the photosensitive unit 4.

The charging roller 8 provided in the photosensitive unit 4 is biased by charging roller pressing springs 36 disposed at both ends of the charging roller 8 in a direction (direction indicated by an arrow C) toward the photosensitive drum 7. The charging roller 8 is provided so as to move following the photosensitive drum 7. When the photosensitive drum 7 is driven to rotate in the direction indicated by the arrow A during the image formation, the charging roller 8 rotates in a direction indicated by an arrow D (direction of forward rotation of the photosensitive drum 7).

The cleaning blade 10 provided in each of the photosensitive units 4 includes an elastic member 10*a* for removing the post-transfer remaining toner (waste toner) remaining on the surface of the photosensitive drum 7 after the primary transfer and a supporting member 10*b* for supporting the elastic member 10*a*. The waste toner removed by the cleaning blade 10 from the surface of the photosensitive drum 7 is contained in a waste toner containing chamber 9 formed of the cleaning blade 10 and the photosensitive unit frame body 5. The waste toner contained in the waste toner containing chamber 9 is transported by the waste toner transport screw 15 disposed in the waste toner containing chamber 9 to a rear side of the image forming apparatus 100 (downstream in a direction in which the process cartridge 1 is attached/detached). The transported waste toner is discharged from a waste toner discharge portion 35 and delivered to the waste toner transport unit 23 of the image forming apparatus 100.

The developing unit 6 includes a development frame body 16 supporting various members in the developing unit 6. The development frame body 16 is divided into a development chamber 16*a* in which the developing roller 11 and a supply roller 17 are provided and a toner containing chamber 16*b* in which the toner is contained and a stirring member 29 is provided.

In the development chamber 16*a*, the developing roller 11, the supply roller 17, and a developing blade 28 are provided. The developing roller 11 bears the toner, rotates in a direction indicated by an arrow E during the image formation, and comes into contact with the photosensitive drum 7 to transport the toner to the photosensitive drum 7. The developing roller 11 is supported at both end portions thereof in a longitudinal direction thereof (direction of the rotation axis) by the development frame body 16 so as to be rotatable by a development bearing unit 34.

In the development bearing unit 34 of the developing unit 6, an Oldham's unit 50 is disposed to receive a drive force from the apparatus main body 101 and transmit the drive force to the supply roller 17 and the developing roller 11. The Oldham's unit 50 functions as a drive interface that receives the drive force from the apparatus main body 101. The Oldham's unit 50 is biased by a spring not shown toward the photosensitive unit frame body 5 (cleaning bearings 33). When the photosensitive unit frame body 5 is positioned, a reactive force of the photosensitive unit frame body 5 acts such that the developing unit 6 rotates to separate from the photosensitive unit frame body 5. However, a magnitude of the reactive force is extremely small compared to a turning moment when the developing unit 6 rotates due to a weight thereof around the rotary support pin 30 and is constant irrespective of a weight of the remaining toner. Accordingly, the reactive force does not affect sensing of the remaining toner amount by the remaining-toner-amount sensing unit 70.

The supply roller 17 is supported by the development frame body 16 so as to be rotatable by the development bearing unit 34, while being in contact with the developing roller 11, and rotates in a direction indicated by an arrow F at the time of image forming. In addition, the developing blade 28 serving as a layer thickness control member that controls a thickness of a toner layer formed on the developing roller 11 is disposed so as to come into contact with the surface of the developing roller 11.

In the toner containing chamber 16*b*, the stirring member 29 is provided to stir the contained toner and also transport the toner to the supply roller 17 via a development chamber communication port 16*c*. The stirring member 29 includes a rotation shaft 29*a* parallel with the direction of the rotation axis of the developing roller 11 and stirring sheets 29*b* serving as transport members which are flexible sheets. Each of the stirring sheets 29*b* has one end attached to the rotation shaft 29*a* and the other end serving as a free end. The rotation shaft 29*a* rotates to rotate each of the stirring sheets 29*b* in a direction indicated by an arrow G, and consequently the toner is stirred by the stirring sheets 29*b*.

The developing unit 6 has the development chamber communication port 16*c* communicating with each of the development chamber 16*a* and the toner containing chamber 16*b*. In the first embodiment, when the developing unit 6 is in a normally used position (position during an in-use period), the development chamber 16*a* is located above the toner containing chamber 16*b*. The toner in the toner containing chamber 16*b* that has been pumped up by the stirring member 29 is supplied to the development chamber 16*a* through the development chamber communication port 16*c*.

In the developing unit 6, a receiving port 40 is provided in one downstream end thereof in the attachment/detachment direction. Above the toner receiving port 40, a receiving port seal member 45 and a toner receiving port shutter 41 movable in the front-rear direction are disposed. When the process cartridge 1 is not attached to the image forming apparatus 100, the toner receiving port 40 is closed by the receiving port shutter 41. The receiving port shutter 41 is configured to operate in association with an operation of attaching/detaching the process cartridge 1 and be biased toward the image forming apparatus 100 to be opened.

A receiving transport path 42 is provided to communicate with the toner receiving port 40. Inside the receiving transport path 42, a receiving transport screw 43 is disposed. Additionally, in the vicinity of a longitudinal middle of the developing unit 6, a containing chamber communication port 44 for supplying the toner to the toner containing chamber 16*b* is provided to provide communication between the receiving transport path 42 and the toner containing chamber 16*b*. The receiving transport screw extends in parallel with the respective directions of the rotation axes of the developing roller 11 and the supply roller 17 to transport the toner received from the toner receiving port 40 to the toner containing chamber 16*b* via the containing chamber communication port 44.

In the developing unit 6, a gravity center W is indicated by an arrow. The gravity center W exists in the toner containing chamber 16*b* with respect to the rotary support pin 30. In addition, a counter-contact portion 37 is disposed to come into contact with the remaining-toner-amount sensing unit 70 (described later) provided in the image forming apparatus 100.

It can be said that, when the developing roller 11 and the photosensitive drum 7 are in contact, each of the developing roller 11 and the photosensitive drum 7 is at a development position where development is possible. At this time, the respective portions of the developing roller 11 and the photosensitive drum 7 which are in contact are referred to as a developing portion. Meanwhile, when each of the developing roller 11 and the photosensitive drum 7 is at a separation position where the developing roller 11 and the photosensitive drum 7 are separate from each other, it is possible to sense a magnitude of a force corresponding to a weight of the toner according to the present invention.

In the development bearing unit 34 of the developing unit 6 and the photosensitive unit frame body 5, a restricted portion 60 and a restricting portion 61 each for determining the separation position where the developing roller 11 and the photosensitive drum 7 are separate from each other are provided respectively. When the developing roller 11 and the photosensitive drum 7 separate from each other, the restricted portion 60 comes into contact with the restricting portion 61 of the photosensitive unit frame body 5 positioned in advance to determine the separation position of the developing roller 11 relative to the photosensitive drum 7.

It is preferable herein that the rotary support pin 30 is located below the developing portion in a gravity direction. When a biasing force exerted by the developing unit 6 on the photosensitive unit 4 is removed, the developing unit 6 rotates due to a weight thereof around the rotary support pin 30 to thus be located at the separation position. As a result, the force exerted on the remaining-toner-amount sensing unit 70 corresponds to a force based on the respective weights of the toner and the container from which the biasing force has been removed.

A position of the gravity center W is required to be located downstream of the rotary support pin 30 in a horizontal direction which is perpendicular to the gravity direction and in which the developing roller 11 moves, while separating from the photosensitive drum. In other words, the position of the gravity center W is more distant from the developing portion than a position of the rotary support pin 30 in the horizontal direction mentioned above. Conversely, the position of the rotary support pin 30 is closer to the developing portion than the position of the gravity center W in the horizontal direction mentioned above. As a result, when a gravity force acts on the developing unit 6 containing the toner to move the developing unit 6 around the rotary support pin 30 and separate the developing roller 11 from the photosensitive drum 7, the remaining-toner-amount sensing unit 70 receives a force from the developing unit 6. The received force results from a moment corresponding to the amount of the remaining toner. The remaining-toner-amount sensing unit 70 physically changes on the basis of a magnitude of the received force, and the resulting variation is sensed.

Note that, in FIG. 3, the rotary support pin 30 (rotation shaft) is located between a position of the developing portion and the position of the gravity center W of the developing unit 6 in the horizontal direction perpendicular to the gravity direction. Meanwhile, the biasing force exerted on the Oldham's unit 50 described above functions to increase the force resulting from the moment due to a reactive force received from the cleaning bearings 33. The biasing force is constant irrespective of the weight of the toner.

Configuration of Remaining-Toner-Amount Sensing Unit

Figure 1B:
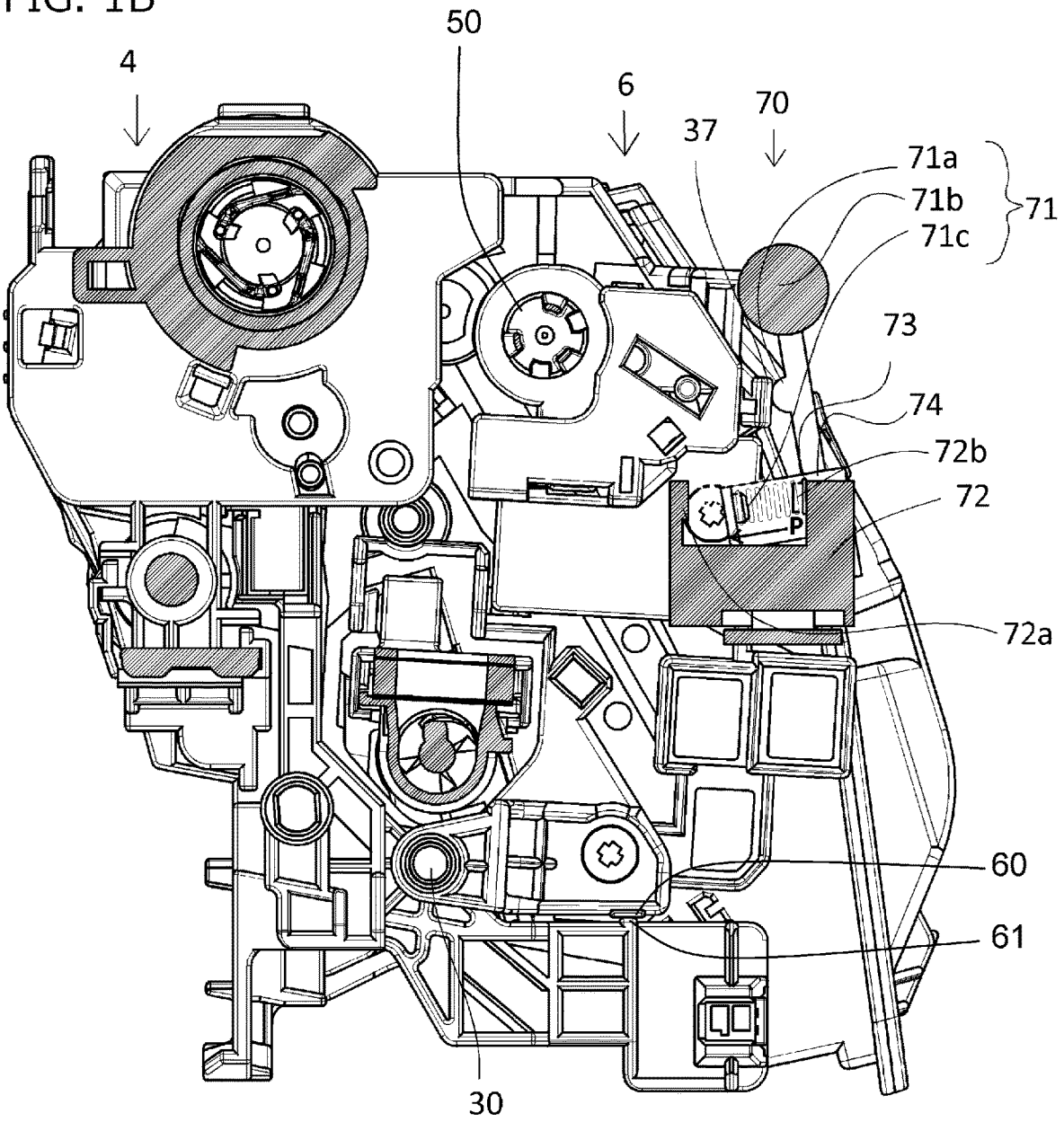
FIG. 1B is a cross-sectional view of the remaining-toner-amount sensing unit during measurement of a remaining toner amount according to the first embodiment.
Figure 1C:
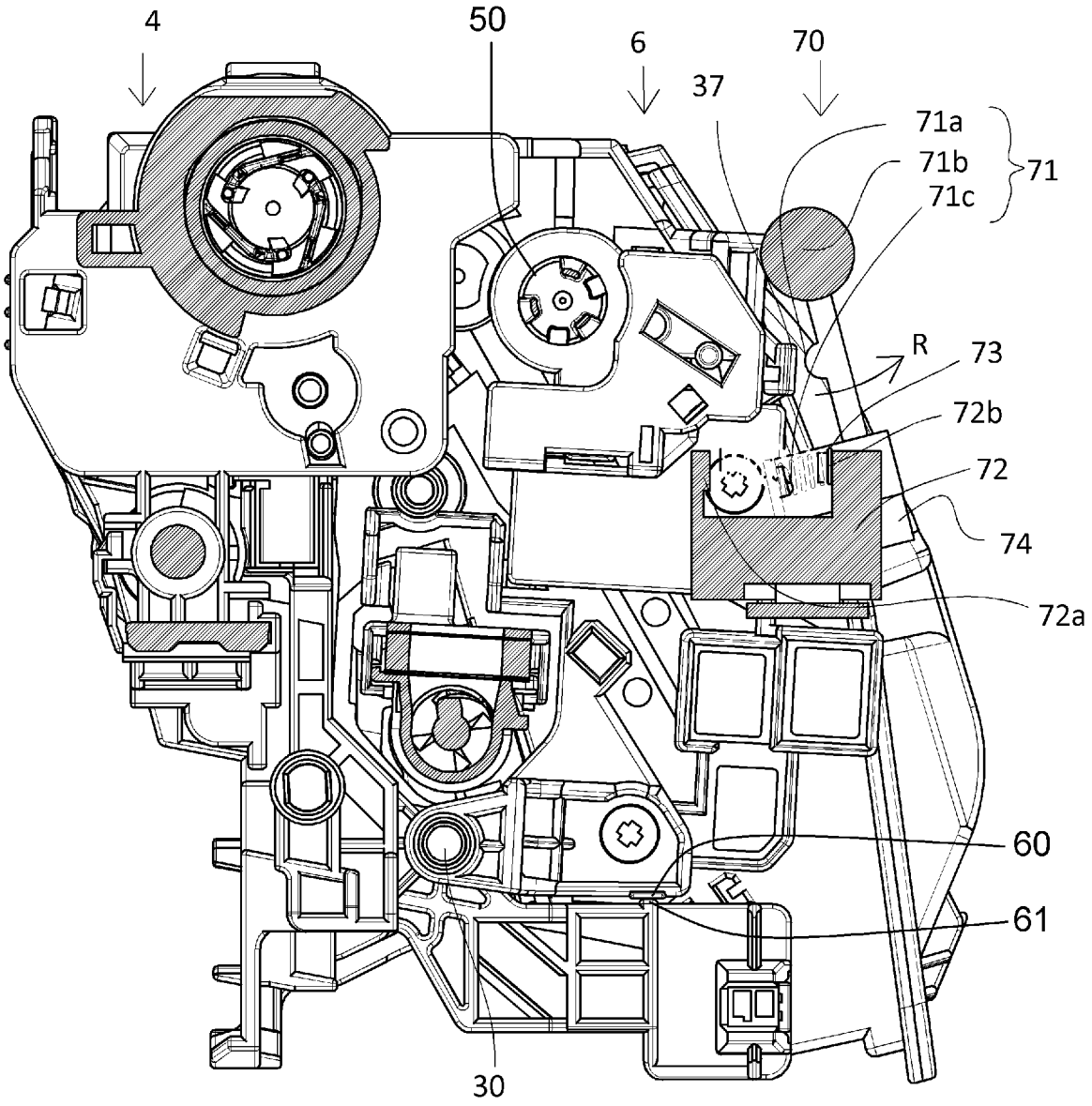
FIG. 1C is a cross-sectional view of the remaining-toner-amount sensing unit during development separation according to the first embodiment.

Referring to FIGS. 1A to 1C, 5A to 5E, and 8A to 8C, a description will be given of a configuration of the remaining-toner-amount sensing unit 70 (sensing portion). FIG. 1A is a cross-sectional view of the remaining-toner-amount sensing unit during image formation in the process cartridge according to the first embodiment. FIG. 1B is a cross-sectional view of the remaining-toner-amount sensing unit during measurement of the amount of the remaining toner in the process cartridge according to the first embodiment. FIG. 1C is a cross-sectional view of the remaining-toner-amount sensing unit during complete development separation in the process cartridge according to the first embodiment.

Figure 5A:
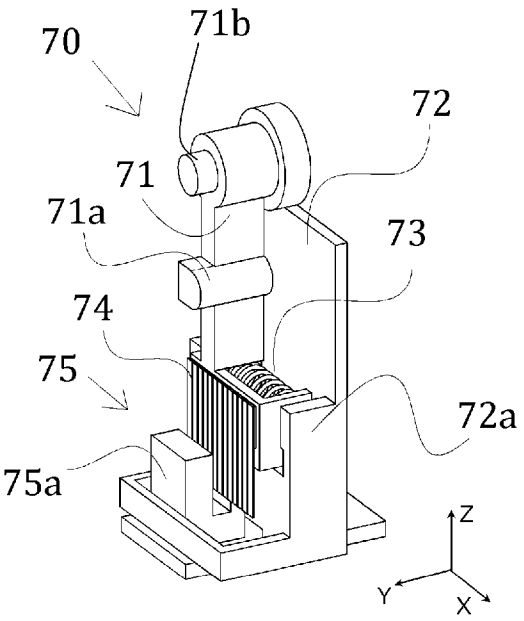
FIGS. 5A to 5E are diagrams of the remaining-toner-amount sensing unit according to the first embodiment.
Figure 5B:
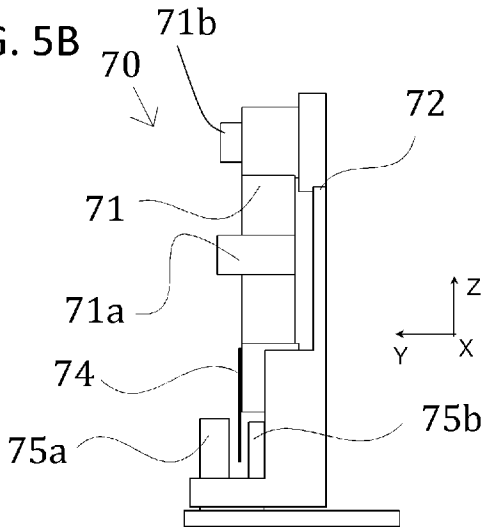
Figure 5C:
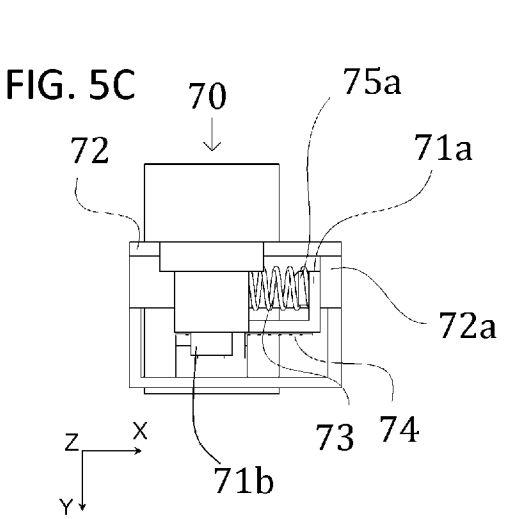
Figure 5D:
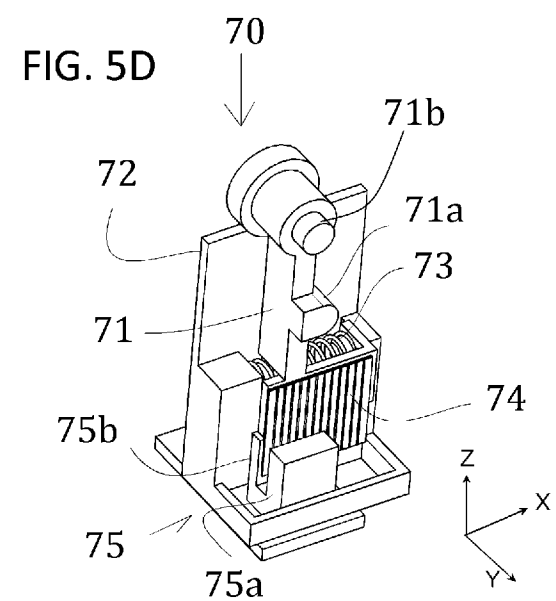
Figure 5E:
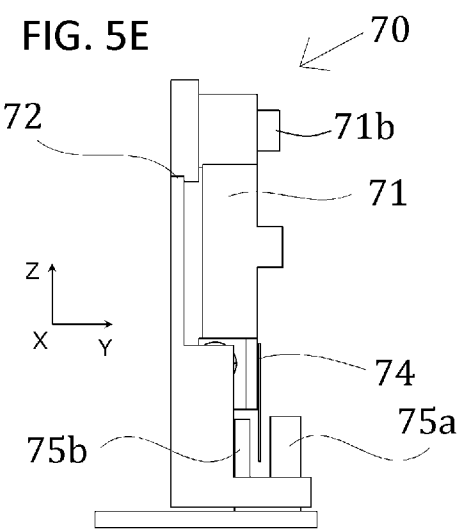

FIG. 5A is a first perspective view of the remaining-toner-amount sensing unit according to the first embodiment. FIG. 5B is a first side view of the remaining-toner-amount sensing unit in the first embodiment. FIG. 5C is a top view (plan view) of the remaining-toner-amount sensing unit according to the first embodiment. FIG. 5D is a second perspective view of the remaining-toner-amount sensing unit according to the first embodiment when viewed in a direction different from that in FIG. 5A. FIG. 5E is a second side view of the remaining-toner-amount sensing unit according to the first embodiment when viewed in a direction opposite to that in FIG. 5B.

Figure 8A:
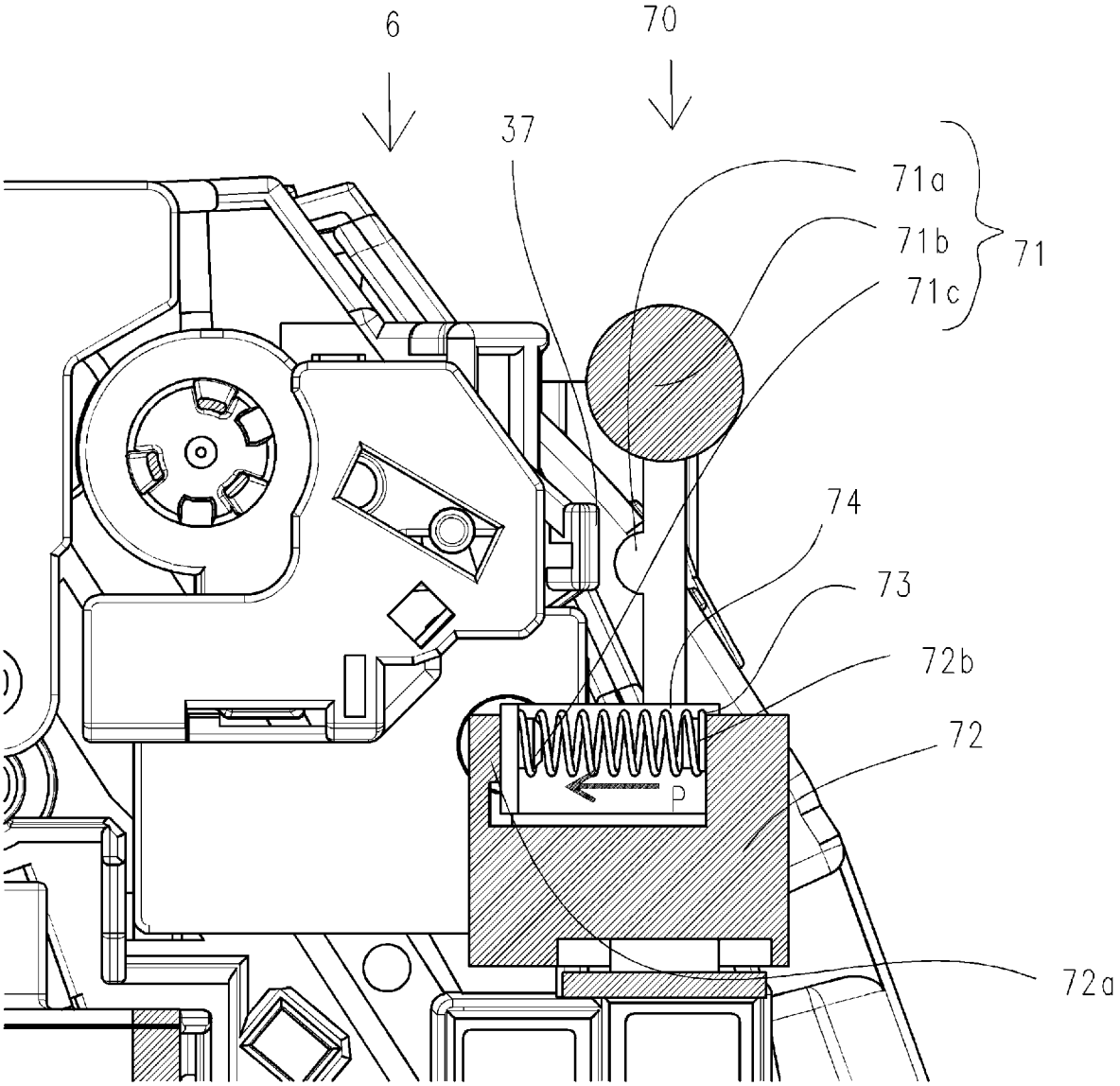
FIG. 8A is an enlarged view of the remaining-toner-amount sensing unit during image formation according to the first embodiment.
Figure 8B:
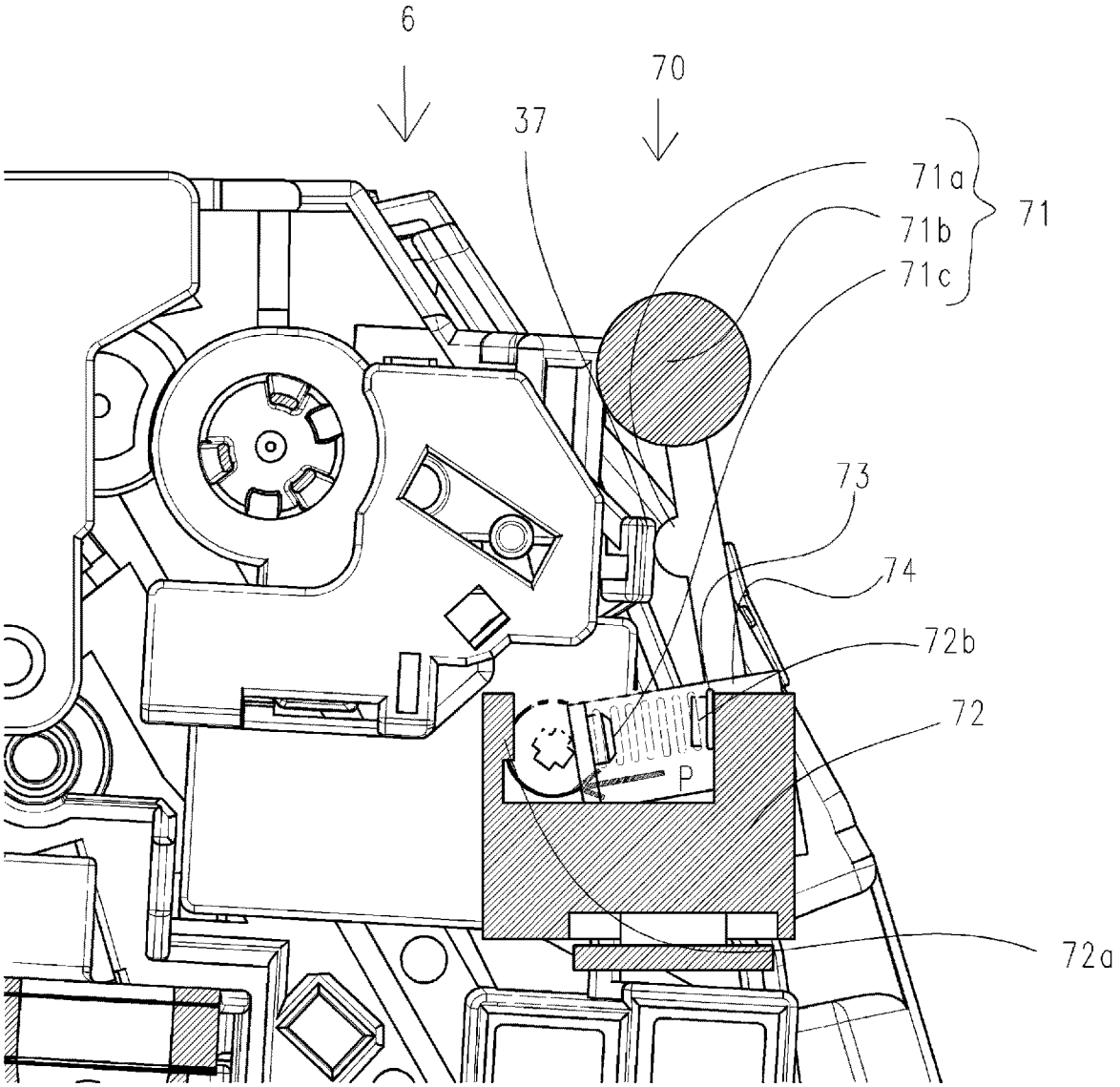
FIG. 8B is an enlarged view of the remaining-toner-amount sensing unit during measurement of the remaining toner amount according to the first embodiment.
Figure 8C:
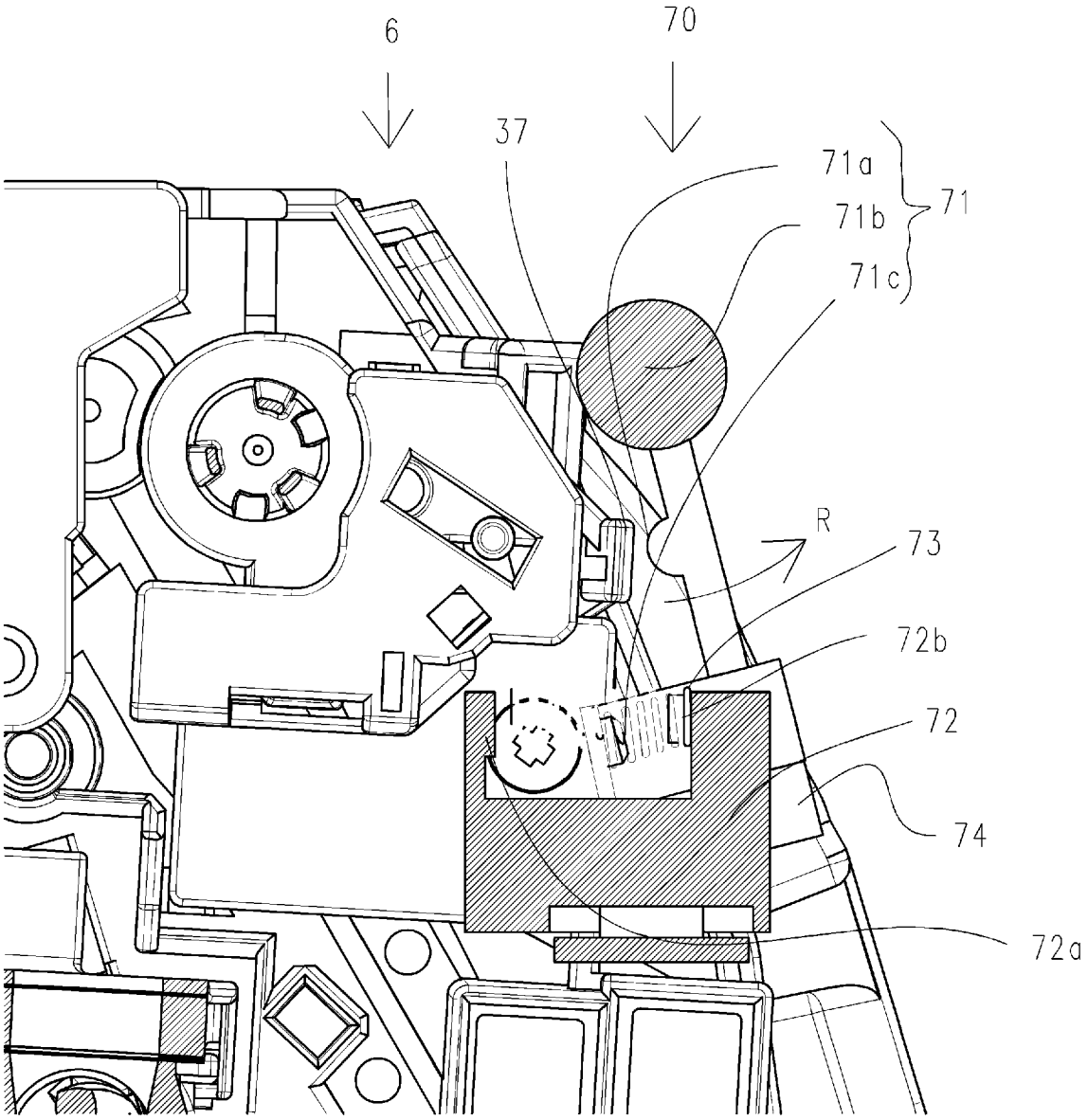
FIG. 8C is an enlarged view of the remaining-toner-amount sensing unit during development separation according to the first embodiment.

FIG. 8A is an enlarged view of the remaining-toner-amount sensing unit during image formation in the process cartridge according to the first embodiment. FIG. 8B is an enlarged view of the remaining-toner-amount sensing unit during measurement of the amount of the remaining toner in the process cartridge according to the first embodiment. FIG. 8C is an enlarged view of the remaining-toner-amount sensing unit during the development separation in the process cartridge according to the first embodiment.

As illustrated in FIG. 5A, the remaining-toner-amount sensing unit 70 is configured to include a sensing lever 71, a holder member 72, a spring 73, a slit portion 74 (optical sensing member), and a sensor portion 75 (optical sensor). As illustrated in FIGS. 5B and 5E, the sensor portion 75 is configured to include a light emitting portion 75*a* and a light receiving portion 75*b*.

As can be seen from a comparison made between FIGS. 1A and 1C, the sensing lever 71 is held so as to be rotatable around the rotation shaft 71*b* relative to the holder member 72. As also illustrated in FIGS. 8A to 8C, the spring 73 is disposed between a boss 71*c* of the sensing lever 71 and a boss 72*b* of the holder member 72. At this time, by a biasing force P of the spring 73, the sensing lever 71 is constantly biased toward an abutment portion 72*a* of the holder member 72.

As also illustrated in FIGS. 5B, 5D, and 5E, the sheet-like slit portion 74 is attached to a tip of the sensing lever 71 so as to extend through the light emitting portion 75*a* and the light receiving portion 75*b* of the sensor portion 75 disposed on the holder member 72.

By combining the sensor portion 75 with the slit portion 74, it is possible to measure a mechanical positional change of the sensing lever 71, which results from the rotation thereof, by the number of times light reception by the light receiving portion 75*b* is blocked by passage of lines and allow the control portion 120 to detect a variation (positional change information) of the sensing lever 71.

The slit portion 74 is a transparent plate-like/sheet-like member on which black lines horizontal to a Z-direction are printed at predetermined intervals. A color of the lines on the slit portion 74 is not limited to black as long as a plurality of lines in a color sufficient to block the light are provided on a planar member to be spaced apart at predetermined intervals in a direction crossing a direction in which the developing unit moves. In a separate state, a relative positional relationship between the slit portion 74 and the sensor portion 75 varies with a magnitude of a weight of the developing unit including the toner.

Sensing of Remaining Toner Amount

Figure 6A:
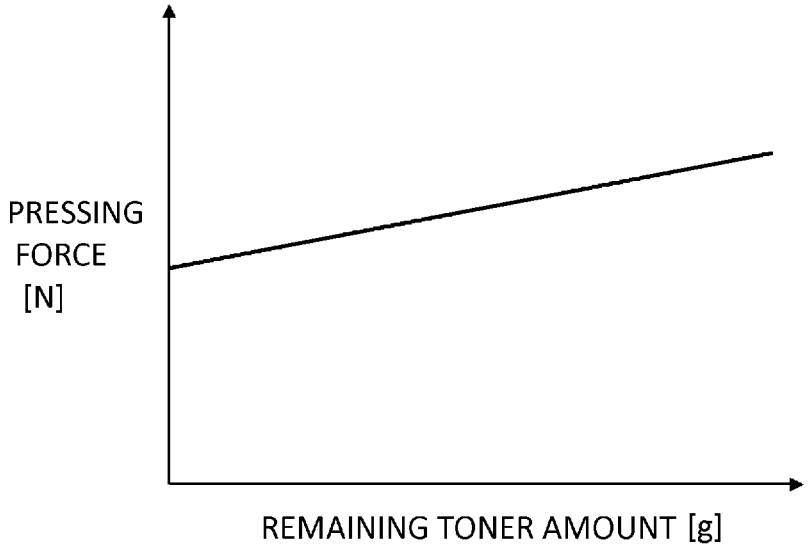
FIGS. 6A and 6B are graphs illustrating relations among the remaining toner amount, a pressing force, and a pulse number according to the first embodiment.
Figure 6B:
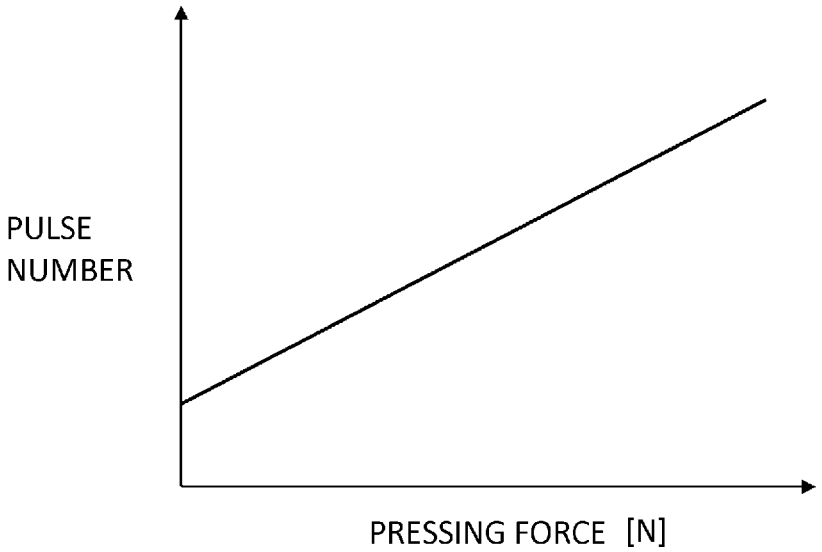

Referring to FIGS. 1A to 1C, 2, 6A and 6B, and 8A to 8C, a description will be given of sensing of the amount of the remaining toner. FIG. 6A is a graph illustrating a relationship between a remaining toner amount (g) in the developer containing chamber and a pressing force (N) exerted on the counter-contact surface of the developing unit according to the first embodiment. FIG. 6B is a graph illustrating a relationship between the pressing force (N) exerted on the counter-contact surface of the developing unit and a pulse number which is a return value from the remaining-toner-amount sensing unit according to the first embodiment. A pulse number corresponds to the number of times light blocking and light transmitting are repeatedly performed in conjunction with the rotation of the sensing lever 71, with the light blocking being a process in which a black line portion of the slit portion 74 blocks the light reception by the light receiving portion 75*b* and the light transmitting being a process in which a transparent portion of the slit portion 74 transmits the light. The control portion 120 senses a value of the number of repetitions to be able to sense a variation (positional change information) of the sensing lever 71. The relationship illustrated in FIGS. 6A and 6B may appropriately be stored in the form of, e.g., a formula or a table in the memory of the control portion 120 to be usable for arithmetic processing to be performed by the control portion 120.

As can be seen from FIGS. 6A and 6B, to the remaining toner amount serving as an amount to be sensed, a specified pulse number corresponds. By detecting the specified pulse number, the control portion 120 can perform response processing when a predetermined remaining toner amount is detected. Examples of the response processing when the predetermined remaining toner amount is detected includes reporting of the remaining toner amount, toner refeeding, and the like.

As illustrated in FIG. 2, during the image formation in the process cartridge 1, each of the developing units 6 is pressed by the developing/pressing unit 38 provided in the main body of the image forming apparatus 100, while the developing roller 11 is in contact with the photosensitive drum 7.

At this time, as illustrated in FIGS. 1A and 8A, there is a gap between a contact portion 71*a* of the sensing lever 71 of the remaining-toner-amount sensing unit 70 and the counter-contact portion 37 of the developing unit 6 each provided in the main body of the image forming apparatus 100.

At the same time when an image forming process is ended, the pressing by each of the developing/pressing units 38 provided in the main body of the image forming apparatus 100 described above is released, and the biasing of the photosensitive drum 7 by the developing roller 11 is cancelled. As a result, due to the weight of the developing unit 6, the developing unit 6 swings (rotates) around the rotary support pin 30 in a direction in which the developing roller 11 separates from the photosensitive drum 7. At this time, as illustrated in FIGS. 1B and 8B, the contact portion 71*a* of the sensing lever 71 of the remaining-toner-amount sensing unit 70 provided in the main body of the image forming apparatus 100 comes into contact with the counter-contact portion 37 of the developing unit 6 provided in the main body of the image forming apparatus 100. As also described previously, the force received by the contact portion 71*a* has a value corresponding to a magnitude of the gravity center W of the developing unit 6 including the remaining toner amount in the toner containing chamber 16*b*. As the magnitude of the gravity center W is larger, the turning moment due to the developing unit 6 is accordingly larger.

Then, the sensing lever 71 starts to rotate around the rotation shaft 71*b*, and stops rotating at a position where the pressing force exerted on the counter-contact portion 37 of the developing unit 6 is in equilibrium to the biasing force P exerted by the spring 73. At this time, there is a gap between the restricted portion 60 and the restricting portion 61.

In other words, at this time, an equilibrium is established between the moment generated when the developing unit 6 rotates around the rotation shaft and a moment resulting from the pressing of the developing unit 6 by the contact portion 71*a*. Accordingly, the remaining-toner-amount sensing unit 70 measures a force exerted at this time as a variation of the position of the sensing lever 71.

As illustrated in FIG. 6A, the remaining toner amount in the toner containing chamber 16*b* and the pressing force exerted on the counter-contact portion 37 of the developing unit 6 have a correlationship therebetween. When the remaining toner amount in the toner containing chamber 16*b* increases, the pressing force exerted on the counter-contact portion 37 of the developing unit 6 also increases, and the biasing force P in equilibrium therewith also increases.

At this time, the control portion 120 counts the number of the passed black lines on the slit portion 74 attached to the tip of the sensing lever 71 on the basis of an output signal from the sensor portion 75, and calculates the pulse number as the return value.

As illustrated in FIG. 6B, the pressing force exerted on the counter-contact portion 37 of the developing unit 6 and the pulse number corresponding to the number of the passed black lines on the slit portion 74 have a correlation therebetween. Accordingly, by using the relationships illustrated in FIGS. 6A and 6B, the control portion 120 can calculate the remaining toner amount in the toner containing chamber 16*b*. Then, the control portion 120 performs response processing when the predetermined remaining toner amount is detected on the basis of the calculated remaining toner amount. Since the predetermined remaining toner amount corresponds to a predetermined pulse number, the control portion 120 may also perform the response processing mentioned above in response to the detection of the predetermined pulse number without calculating the remaining toner amount.

When the sensing of the remaining toner amount is ended, as illustrated in FIGS. 1C and 8C, a cum mechanism (not shown) provided in the main body of the image forming apparatus 100 causes the sensing lever 71 to retract in a direction indicated by an arrow R. This provides a positional relationship in which the contact portion 71*a* of the sensing lever 71 is not in contact with the counter-contact portion 37 of the developing unit 6. Due to such retraction of the sensing lever 71 to a position where the contact portion 71*a* of the sensing lever 71 is not in contact with the counter-contact portion 37 of the developing unit 6, it is possible to reliably perform an operation of separating the photosensitive drum 7 from the developing roller 11 in the process cartridge 1. In addition, attachment/detachment of the process cartridge 1 to/from the main body of the image forming apparatus 100 is no longer interrupted, and it is possible to prevent a damage to the sensing lever 71 or the like. At this time, the restricted portion 60 and the restricting portion 61 are in contact, and the separation position where the developing roller 11 and the photosensitive drum 7 are separate from each other is determined. When it is assumed that an amount of separation (an amount of the rotation of the developing unit 6 relative to the photosensitive unit 4) illustrated in FIGS. 1B and 8B is a first separation amount and an amount of separation in FIGS. 1C and 8C is a second separation amount, a relationship given by First Separation Amount<Second Separation Amount is established.

Thus, according to the first embodiment, when the remaining toner amount in the process cartridge is sensed, the pressing by the developing/pressing unit 38 is cancelled, and a pressure due to the weight of the container containing the remaining toner is sensed. As a result, it is possible to remove influence of pressing based on spring biasing which is exerted on pressure measurement, and accurately measure the remaining toner amount.

While the first embodiment has described, by way of example, a measurement method in which the slit portion and the sensor each attached to the sensing lever of the remaining-toner-amount sensing unit measure an amount of movement of the counter-contact portion of the developing unit to measure the remaining toner amount, a means for measuring the amount of movement is not limited thereto. In another example of the optical method for measuring the amount of movement, it may also be possible to sense the movement of the developing unit using a photosensor or the like. Alternatively, a method other than the optical method may also be used.

In other words, the remaining-toner-amount sensing unit may have any configuration as long as the remaining-toner-amount sensing unit can sense a variation determined by the remaining toner amount or a value related to the remaining toner amount. In the configuration having the slit portion and the optical sensor described above, the number of slits in the slit portion sensed by the optical sensor may be used appropriately as the variation or, alternatively, a pressing force based on the number of the slits may also be used as the variation.

Second Embodiment

Next, a form of the second embodiment will be described with reference to the drawings.

Note that, in the second embodiment, a detailed description will be given of portions different from those in the first embodiment described above. Materials, shapes, and the like are the same as those in the first embodiment described above unless particularly specified otherwise. Such portions are given the same reference numerals, and a detailed description thereof is omitted.

Configuration of Remaining-Toner-Amount Sensing Unit

Figure 7A:
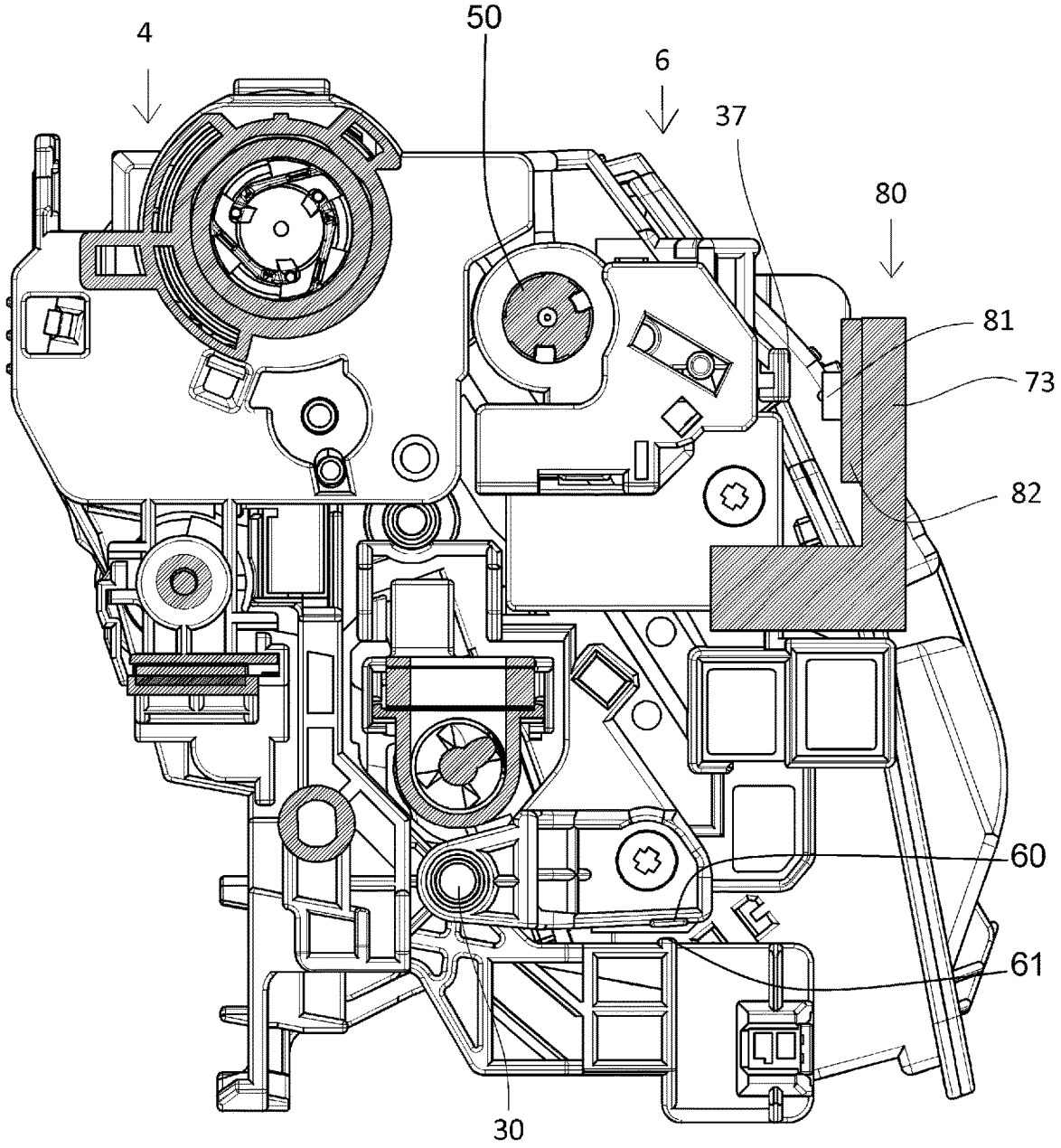
FIG. 7A is a cross-sectional view of the remaining-toner-amount sensing unit during an image formation period according to a second embodiment.
Figure 7B:
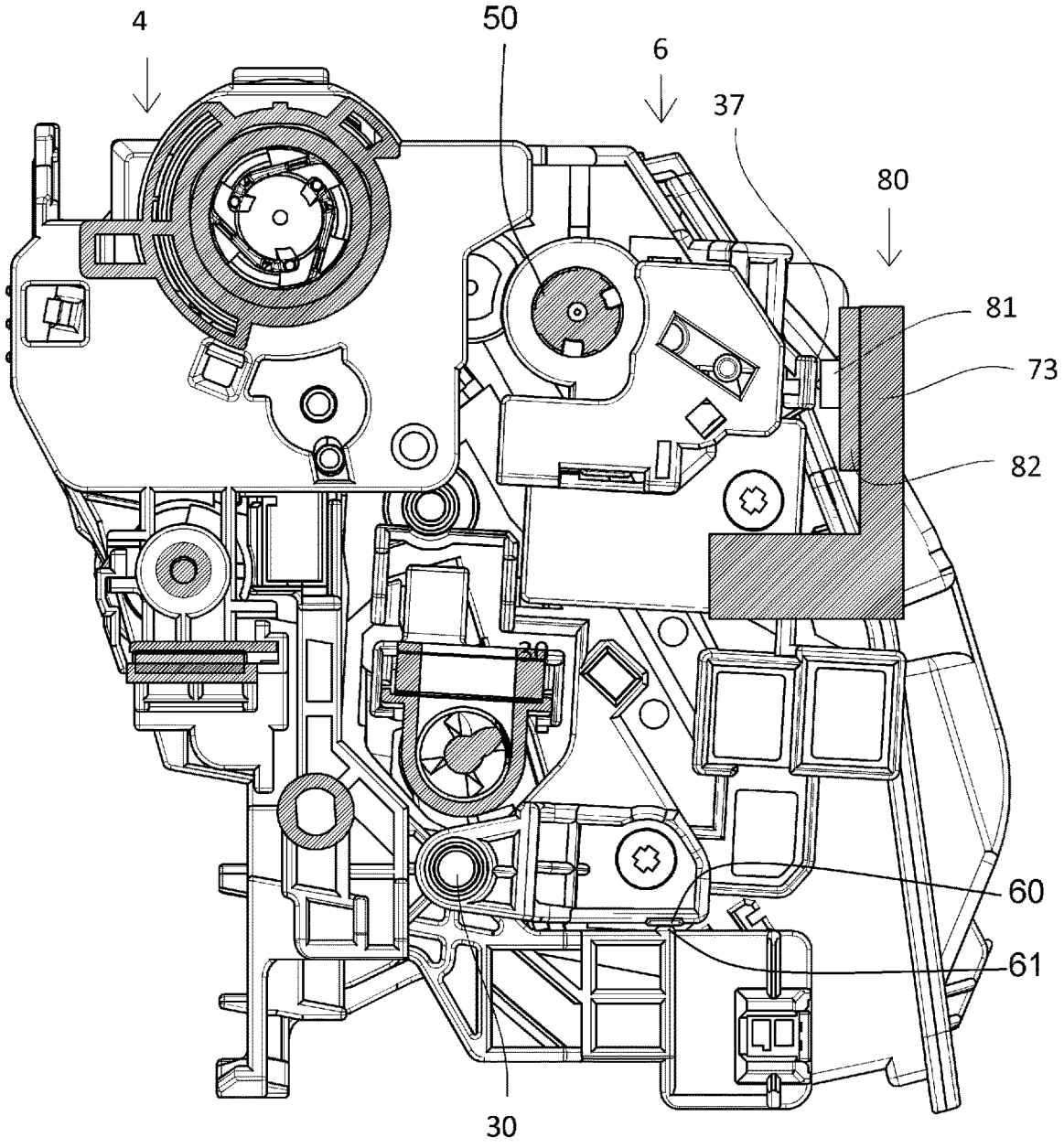
FIG. 7B is a cross-sectional view of the remaining-toner-amount sensing unit during a remaining-toner-amount measurement period according to the second embodiment.
Figure 7C:
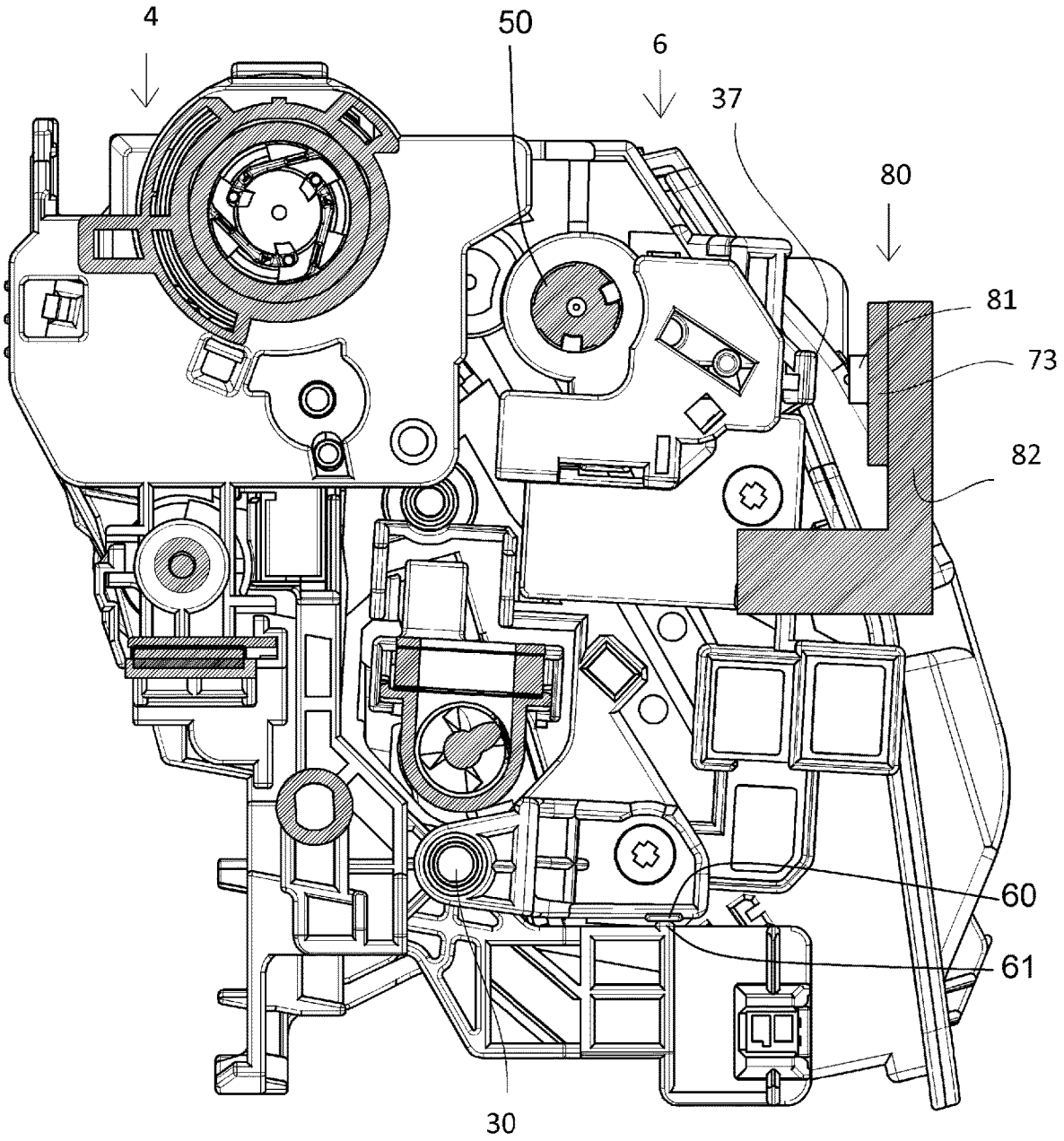
FIG. 7C is a cross-sectional view of the remaining-toner-amount sensing unit during a development separation period according to the second embodiment.

Referring to FIGS. 7A to 7C, a description will be given of a configuration of a remaining-toner-amount sensing unit 80. FIG. 7A is a cross-sectional view of a remaining-toner-amount sensing unit during image formation in a process cartridge according to the second embodiment. FIG. 7B is a cross-sectional view of the remaining-toner-amount sensing unit during measurement of a remaining toner amount in the process cartridge according to the second embodiment. FIG. 7C is a cross-sectional view of the remaining-toner-amount sensing unit during development separation in the process cartridge according to the second embodiment.

As illustrated in FIGS. 7A to 7C, the remaining-toner-amount sensing unit 80 is configured to include a load sensor 81, a base 82, and a holder member 83. As an example of the load sensor 81, a load cell (load converter) that senses an electric resistance change resulting from a strain formed under a load in an inner structure can be used. A relationship between a value of the electric resistance and the load may also be stored as a formula or a table in the memory of the control portion 120.

However, a method of mounting the load sensor is not particularly limited. Not only a load sensor of a gauge type such as a semiconductor gauge type or a strain gauge type, but also a load sensor of an electrostatic capacitance type, a load sensor using a diaphragm, or the like may be selected appropriately depending on required performance, a use environment, or cost.

Sensing of Remaining Toner Amount

Referring to FIGS. 2 and 7A to 7C, a description will be given of sensing of the remaining toner amount.

As illustrated in FIG. 2, during image formation in the process cartridge 1, each of the developing units 6 is pressed by the developing/pressing unit 38 provided in the main body of the image forming apparatus 100, while the developing roller 11 is in contact with the photosensitive drum 7.

In the second embodiment, at this time, as illustrated in FIG. 7A, there is a gap between the load sensor 81 of the remaining-toner-amount sensing unit 80 provided in the main body of the image forming apparatus 100 and the counter-contact portion 37 of the developing unit 6.

At the same time when an image forming process is ended, the pressing by each of the developing/pressing units 38 provided in the main body of the image forming apparatus 100 described above is released, and the biasing of the photosensitive drum 7 by the developing roller 11 is cancelled. As a result, due to the weight of the developing unit 6, the developing unit 6 swings around the rotary support pin 30 in a direction in which the developing roller 11 separates from the photosensitive drum 7. At this time, as illustrated in FIG. 7B, the load sensor 81 of the remaining-toner-amount sensing unit 80 provided in the main body of the image forming apparatus 100 comes into contact with the counter-contact portion 37 of the developing unit 6.

Then, the load sensor 81 measures a pressing force (load) exerted on the counter contact portion of the developing unit 6.

At this time, the control portion 120 calculates the amount of the remaining toner corresponding to the pressing force. A relationship between the pressing force and the remaining toner amount may also be stored in advance in the form of a formula or a table in the memory included in the control portion 120.

As illustrated in FIG. 7C, when the sensing of the remaining toner amount is ended, the load sensor 81 is retracted by the cum mechanism (not shown) included in the main body of the image forming apparatus 100 to a position where the load sensor 81 and the counter-contact portion 37 of the developing unit 6 are not in contact with each other. As a result of the retraction of the load sensor 81 to the position where the load sensor 81 and the counter-contact portion 37 of the developing unit 6 are not in contact with each other, it is possible to reliably perform the operation of separating the photosensitive drum 7 and the developing roller 11 from each other in the process cartridge 1. In addition, it is possible to prevent a damage to the load sensor 81 or the like without interrupting the attachment/detachment of the process cartridge 1 to/from the main body of the image forming apparatus 100.

Thus, according to the second embodiment also, it is possible to accurately sense the amount of the toner remaining in the process cartridge.

While the second embodiment has described, by way of example, a measurement method in which the load sensor of the remaining-toner-amount sensing unit measures the pressing force exerted on the counter-contact portion of the developing unit and calculates the remaining toner amount, the means for measuring the pressing force is not limited thereto. For example, it may also be possible to use, instead of the load sensor, a means which measures a pull-out force or a frictional force, calculates the pressing force, and measures the remaining toner amount or the like. For example, in the configuration according to the second embodiment, the load measured by the load sensor serves as the variation or the value corresponding to the remaining toner amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-168875, filed on Sep. 17, 2019, which is hereby incorporated by reference herein in its entirety.

What is claimed is:

1. An image forming unit for use in an image forming apparatus, the image forming unit comprising:

a photosensitive unit including an image bearing member;

a developing unit including a developer bearing member and a container capable of containing a developer;

a rotation shaft, the developing unit being rotated around the rotation shaft and positioned at one of a development position where the developer bearing member contacts with the image bearing member to form a developing portion at which the developer is supplied from the developer bearing member to the image bearing member and a separation position where the developer bearing member separates from the image bearing member; and a sensing unit including a sensor, the sensor being configured to sense a variation or an amount correlated with a weight of the developing unit, wherein the rotation shaft is located below the developing portion in a gravity direction, wherein a gravity center of the developing unit is more distant from the developing portion than the rotation shaft in a horizontal direction perpendicular to the gravity direction, and wherein the sensing unit is configured to restrict the rotation of the developing unit, thereby receiving the weight of the developing unit when the developing unit is at the separation position.

2. The image forming unit according to claim 1, wherein the sensing unit has a contact portion and the developing unit has a counter-contact portion that comes into contact with the contact portion, when the developing unit rotates, and the sensing unit is provided in an apparatus main body of the image forming apparatus and the sensor senses the variation or the amount correlated with the weight of the developing unit, when the contact portion comes into contact with the counter-contact portion.

3. The image forming unit according to claim 2, wherein the sensor senses an amount of movement of the developing unit by an optical method to use the sensed amount of movement as the variation.

4. The image forming unit according to claim 3, wherein the sensor is an optical sensor, the sensing unit includes an optical sensing member provided with a plurality of lines in a direction crossing a direction in which the developing unit rotates, and a relative positional relationship between the optical sensing member and the optical sensor varies in conjunction with the rotation of the developing unit, and the optical sensor calculates the number of the passed lines while the developing unit rotates due to a weight thereof, and uses the calculated number of the lines as the variation.

5. The image forming unit according to claim 3, wherein the sensor senses a load exerted by the developing unit on the sensing unit, and uses the sensed load as the amount.

6. The image forming unit according to claim 5, wherein the sensor is a load cell that senses a load applied by the counter-contact portion to the contact portion.

7. The image forming unit according to claim 1, further comprising a control portion calculating, on the basis of the variation or the amount sensed by the sensor, a remaining toner amount, which is an amount of the developer contained in the developing unit.

8. The image forming unit according to claim 1, wherein the rotation shaft rotatably connects the developing unit to the photosensitive unit.

9. An image forming apparatus comprising:

a photosensitive unit including an image bearing member;

a developing unit, including a developer bearing member and a container capable of containing a developer, configured to develop an electrostatic latent image formed on the image bearing member by using the developer;

a transfer roller configured to transfer, onto a recording material, the image developed by the developing unit, a rotation shaft, the developing unit being rotated around the rotation shaft and positioned at one of a development position where the developer bearing member contacts with the image bearing member to form a developing portion at which the developer is supplied from the developer bearing member to the image bearing member and a separation position where the developer bearing member separates from the image bearing member; and a sensing unit including a sensor, the sensor being configured to sense a variation or an amount correlated with a weight of the developing unit, wherein the rotation shaft is located below the developing portion in a gravity direction, wherein a gravity center of the developing unit is more distant from the developing portion than the rotation shaft in a horizontal direction perpendicular to the gravity direction, and wherein the sensing unit is configured to restrict the rotation of the developing unit, thereby receiving the weight of the developing unit when the developing unit is at the separation position.

* * * * *